US007413298B1

(12) United States Patent
Jones

(10) Patent No.: US 7,413,298 B1
(45) Date of Patent: Aug. 19, 2008

(54) FILTER WICKS FOR INK JET CARTRIDGES

(75) Inventor: Bruce S. Jones, Franklin, TN (US)

(73) Assignee: Nu-kote International, Inc., Franklin, TN (US)

( * ) Notice: Subject to any disclaimer, the term of this patent is extended or adjusted under 35 U.S.C. 154(b) by 201 days.

(21) Appl. No.: 10/972,314

(22) Filed: Oct. 25, 2004

(51) Int. Cl.
*B41J 2/175* (2006.01)

(52) U.S. Cl. ..... 347/86

(58) Field of Classification Search ..... 347/86, 347/85, 93; 55/350.1, 523; 210/493.5
See application file for complete search history.

(56) References Cited

U.S. PATENT DOCUMENTS 5,488,401 A 1/1996 Mochizuki et al.
5,519,425 A * 5/1996 Dietl et al. ..... 347/87
5,547,481 A * 8/1996 Herding et al. ..... 55/523
5,619,239 A 4/1997 Kotaki et al.
5,949,458 A * 9/1999 Studholme ..... 347/86
6,030,558 A 2/2000 Smith et al.
6,059,403 A * 5/2000 Burgin ..... 347/87
6,293,660 B1 9/2001 Kishida et al.
6,293,663 B1 9/2001 Koshikawa et al.
6,540,916 B2 * 4/2003 Patil ..... 210/502.1
6,776,477 B2 8/2004 Putman et al.
6,817,040 B2 * 11/2004 Klinkhammer et al. ..... 4/231
7,112,272 B2 * 9/2006 Hughes et al. ..... 264/41

FOREIGN PATENT DOCUMENTS

JP 409240004 A * 9/1997

* cited by examiner

*Primary Examiner*—Anh T. N. Vo
(74) *Attorney, Agent, or Firm*—Fay Sharpe LLP

(57) ABSTRACT

An ink cartridge having an ink chamber including a wall, an outlet port extending from the wall, an outlet passage through the port and communicating with said chamber and an ink absorbing member in the chamber, is provided with a filter member of sintered plastic material between the ink absorbent member and the passage and a wick member of sintered plastic material in the passage. The wick member has a downstream end in the outlet passage and a printer needle passage extends into the wick member from the downstream end thereof.

29 Claims, 3 Drawing Sheets

FILTER WICKS FOR INK JET CARTRIDGES

BACKGROUND OF THE INVENTION

This invention relates to the art of ink jet cartridges used in ink jet printers and, more particularly, to an improved filter member and/or wick member associated with the outlet passage of an ink chamber of an ink jet cartridge.

It is generally known in the art to form a cartridge housing or body having one or more chambers that hold a predetermined supply of ink and from at least one of which chambers there is an outlet port including an outlet passage which receives a supply needle from an associated printer for conveying ink from the housing to a recording head or the like. It is also generally known to provide an ink absorbing member such as a body of reticulated polyethylene or melamine foam within the housing. In some arrangements, the cartridge housing is divided into multiple chambers, one of which receives the body of ink absorbing material and the other which receives free ink which migrates from its chamber into the ink absorbing material through an opening providing communication between the two chambers. The ink absorbing material controls the flow of ink as it migrates toward the outlet port.

It is generally known too, as shown for example in U.S. Pat. No. 5,488,401 to Mochizuki, et al. and U.S. Pat. No. 6,776,477 to Putman, et al. to cover the inlet end of the outlet passage through the outlet port with a filter member in the form of a plate attached to the bottom wall of the ink chamber such as by heat bonding. Heretofore, such a filter member has been of a high polymer or anti-corrosive metal including, for example, woven nylon screen material and woven stainless steel mesh preferably having a pore size of about 1-25 microns. The filter member is interposed between the outlet passage and ink absorbing member to prevent the entrance of air bubbles, contaminants, and the like from the cartridge.

It is also known as shown, for example, U.S. Pat. No. 5,619,239 to Kotaki, et al., U.S. Pat. No. 6,293,660 to Kishida, et al. and U.S. Pat. No. 6,293,663 to Koshikawa, et al. to provide the outlet passage between the entrance and exit ends thereof with a wick member in the form of a body of fibrous material or bundled fibers of a fibrous material such as polyester, nylon, polypropylene, polyethylene, cellulose, polyurethane, or the like. Other fiber material, such as metallic fiber, glass fiber and carbon fiber can also be used alone or in mixtures with the previously mentioned materials.

While the filter screen and filter materials heretofore used provide the intended filtering functions, the fibers in the woven nylon material appear to swell when used with water based inks, thus losing or reducing the intended flow characteristics. Furthermore, the stainless steel material has to be passivated in order to remove iron from the surface of the mesh, thus to expose more of the chromium and preclude rusting or corrosion of the mesh. While the stainless steel thus treated is acceptable, the passivating process is time-consuming and expensive.

SUMMARY OF THE INVENTION

In accordance with the present invention, sintered plastic material is used as a filter material and/or as a wick material. The sintered plastic does not react to water and thus provides a stable and exacting porosity, thus promoting consistently uniform ink flow and the consistent availability of ink to a printer supply needle received in the outlet passage of the cartridge when the latter contains a filter and/or wick member of the sintered plastic material. Further in this respect, the member of sintered plastic material, preferably a polyethylene material, is made by compacting classified resin particles of predetermined shape and size in a compacting die in which the materials are heated to the melt transition point of the resin. The particles surface bond to each other and create a porosity of exacting value. Filters and other products of such materials, as well as methods of manufacturing the same, are shown for example in patent U.S. Pat. No. 6,030,558 to Smith, et al., the disclosure of which is incorporated herein by reference for background information.

In accordance with one aspect of the invention, a filter member or plate of sintered plastic material is disposed across the inlet end of the outlet passage of an ink cartridge for filtering ink flowing from the ink chamber into the outlet passage. In accordance with another aspect of the invention, the outlet passage of an ink cartridge is provided with a wick in the form of a body of sintered plastic material having a printer needle passage extending thereinto from the downstream end of the body and which, preferably, is of a size and shape which provides clearance between the passage and a printer needle therein. In connection with such a wick member, a resilient seal disk closes the open end of the needle passage and is penetrated by the needle when the latter enters the passage. Preferably, the filter member and wick member are molded or otherwise formed as a one-piece element.

While it is preferred to form the filter member and wick member as a one-piece element, it will be appreciated that the filter member alone can be employed in a cartridge in the manner of filter strips heretofore used and either with or without a wick member of the materials heretofore used therefor in the outlet passage of the cartridge. Likewise, it will be appreciated that a wick member of sintered plastic material can be provided in the outlet passage of the ink cartridge and either with or without a filter strip or screen of the materials heretofore used therefor extending across the inlet end of the passage.

It is an outstanding object of the present invention to provide an improved filter member and/or wick member for filtering and dispersing ink flowing from an ink chamber of an ink jet cartridge into the outlet passage of the cartridge and a printer needle received therein.

Another object is the provision of a filter member and/or wick member of the foregoing character which is produced from sintered plastic material.

A further object is the provision of a filter member and wick member of the foregoing character which are produced as a one-piece element and in which the wick member has a printer needle passage therein having clearance with respect to a printer needle received therein.

Yet another object is the provision of a filter member and/or wick member which provides improved uniformity in ink flow from the ink chamber and continued uniformity of ink flow throughout the life of the cartridge.

BRIEF DESCRIPTION OF THE DRAWINGS

The foregoing objects, and others, will in part be obvious and in part pointed out more fully hereinafter in conjunction with the written description of preferred embodiments of the invention shown in the accompanying drawings in which.

DESCRIPTION OF PREFERRED EMBODIMENTS

Figure 1:
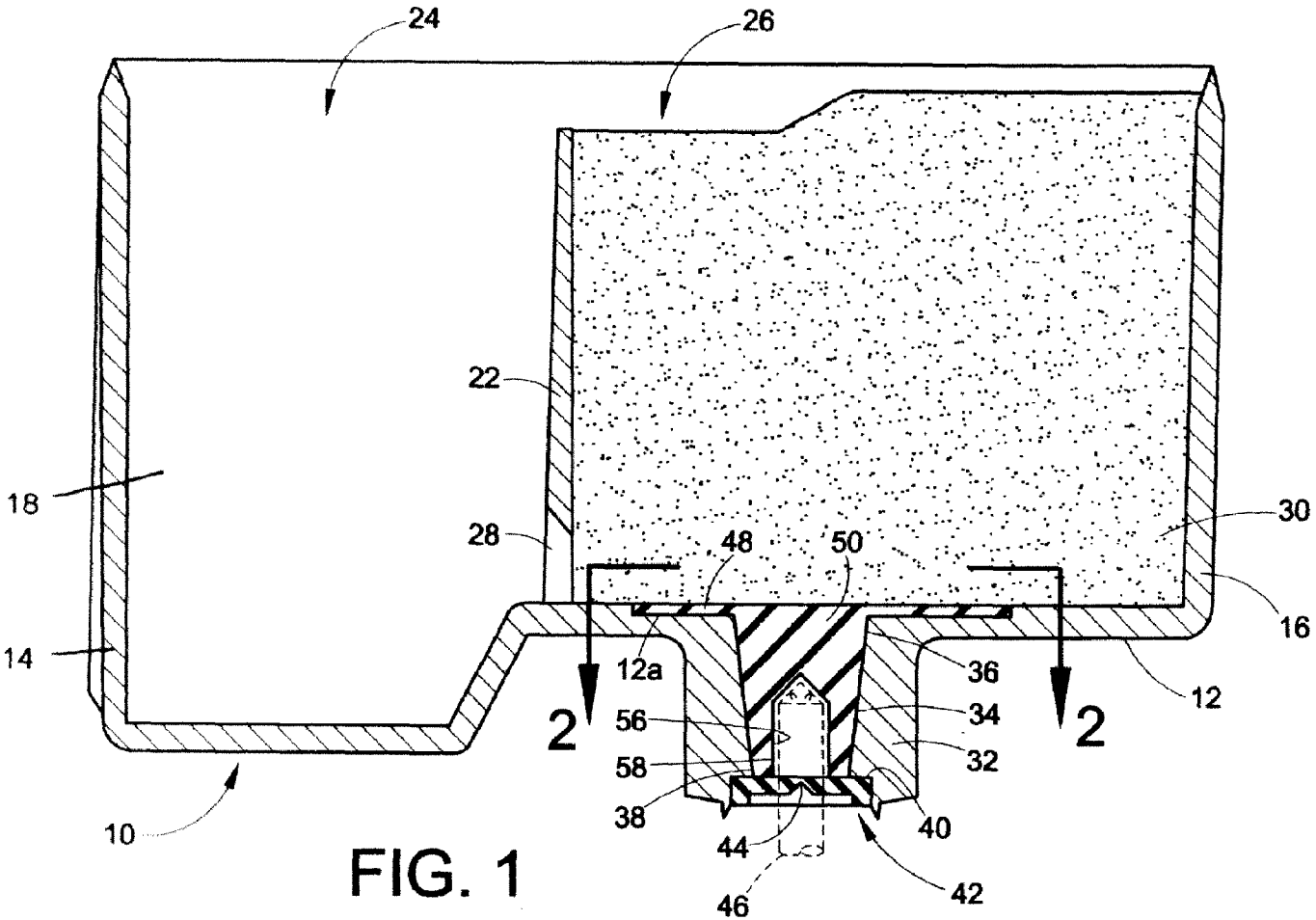
FIG. 1 is a sectional elevation view of an ink jet cartridge having a filter member and wick member in accordance with the present invention.
Figure 2:
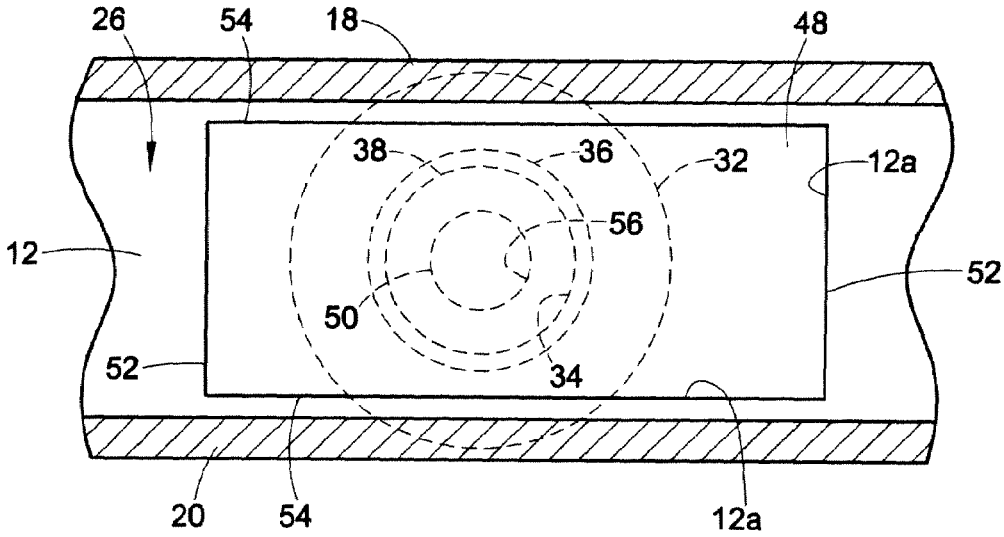
FIG. 2 is a plan view of the filter member and wick member looking in the direction of line 2-2 in FIG. 1.
Figure 3:
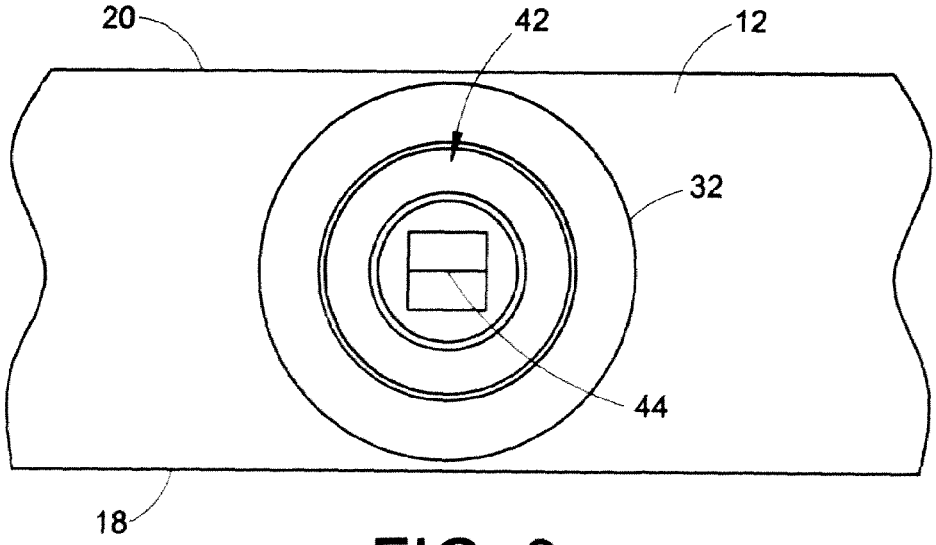
FIG. 3 is a bottom view of the outlet port of the cartridge.

Referring now in greater detail to the drawings, wherein the showings are for the purpose of illustrating preferred embodiments of the invention only, and not for limiting the invention, FIGS. 1-3 illustrate an ink jet cartridge 10 having a bottom wall 12, opposite end walls 14 and 16 and opposite side walls 18 and 20, which walls form an internal cavity which, in the embodiment shown, is divided by a partition wall 22 into chambers 24 and 26. An opening 28 at the lower end of wall 22 communicates the two chambers with each other for ink storage and transfer purposes. More particularly in this respect, chamber 24 is used to store free ink while chamber 26 is used to store ink in an ink absorbing member 30 into which ink migrates from chamber 24. Ink absorbing member 30 is typically a block of porous material or foam such as a reticulated polymer foam or melamine foam, or other conventional ink absorbing material.

Bottom wall 12 of the cartridge is provided with a downwardly extending outlet port or chimney 32, and an outlet passage 34 extends through the port and has an inlet or entrance end 36 communicating with chamber 26 and an exit end 38 adjacent the distal end of the outlet port. The outlet passage is circular in cross-section and tapers downwardly and inwardly in the direction from the entrance end towards the exit end thereof. The exit end of the outlet passage is defined by and terminates at a radially outwardly extending shoulder 40 spaced axially inwardly from the distal end of the outlet port to receive an annular sealing disk 42 which is of a suitable resilient material such as silicone rubber. The axially outer face of the sealing member is provided with a V-shaped notch 44 spaced from the inner face of the sealing member and which is adapted to be pierced by the needle 46 of a printer when the cartridge is inserted in the printer, whereby flow communication is established between the cartridge and printer in a well-known manner.

In accordance with the present invention, a filter member 48 and a wick member 50, preferably of one-piece construction and each comprising a sintered plastic material, is received in chamber 26 for the wick member to be disposed in outlet passage 34 and for the filter member to overlie the inner surface of wall 12 and to extend across inlet end 36 of the outlet passage. In the embodiment illustrated, filter member 48 is rectangular in contour having opposite ends 52 and opposite sides 54 and, preferably, the inner side of bottom wall 12 of the cartridge is provided with a correspondingly contoured recess or pocket 12*a* which receives the filter member such that the upper side thereof is coplanar with the inner side of wall 12. The filter member is in the form of a strip and has a thickness of about 2.14 mm and a length and width greater than the diameter of inlet end 36 of passage 34. Wick member 50 extends outwardly from the bottom side of filter member 48 and has a contour and length corresponding to that of passage 34 and, thus, is circular in cross-section and tapers downwardly and inwardly in the direction from the upstream toward the downstream end thereof. In the preferred embodiment, the wick member has a diameter of 6.43 mm of inlet end 36, a diameter of 4.72 mm at exit end 38 and a length of 8.20 from the inner surface of wall 12 to shoulder 40. The diametrical dimensions provide for passage 34 to have a taper of 0.5°. The downstream end of the filter member is provided with an axially inwardly extending printer needle passage 56 which receives printer needle 46 when the cartridge is inserted into a printer. Needle passage 56 is contoured and dimensioned to provide a clearance space 58 of about 0.20 mm from the outer surface of the needle when the cartridge is in place in a printer. It will be understood that the clearance space is with respect to the entirety of the portion of the needle received in the needle passage. In the preferred embodiment, passage 56, including the clearance space, has a diameter of 2.76 mm and a length of 7.30 mm to the innermost end thereof. As will be appreciated from FIG. 1 and the foregoing description, the filter member and wick member interengage with the bottom wall and outlet passage so as to minimize or eliminate any void area between the filter member, wick member and outlet passage. The sintered plastic material preferably has a porosity of from 1 to 25 microns.

Figure 4:
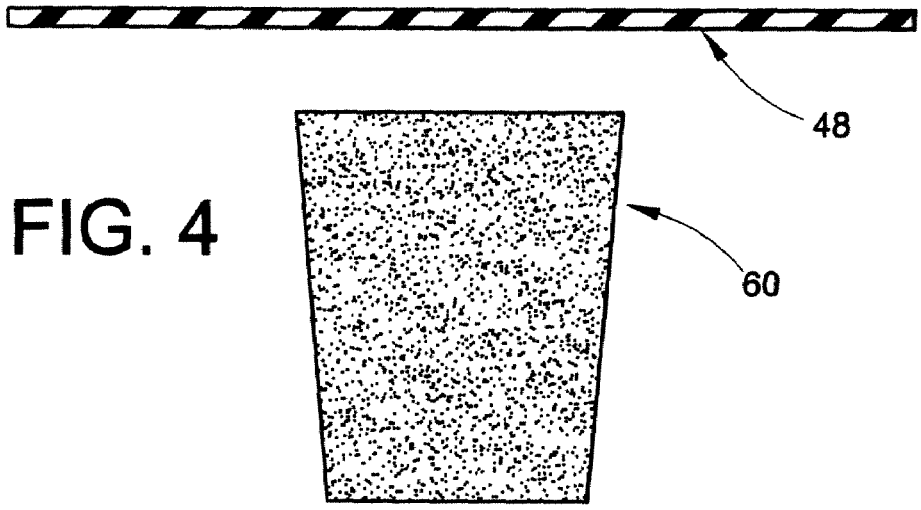
FIG. 4 illustrates a filter member and wick member combination in which the filter member is of a sintered plastic material and a wick member of a material other than sintered plastic; and, FIG. 5 illustrates a filter member and wick member combination in which the wick member is of a sintered plastic material and the filter member is of a material other than sintered plastic.
Figure 5:
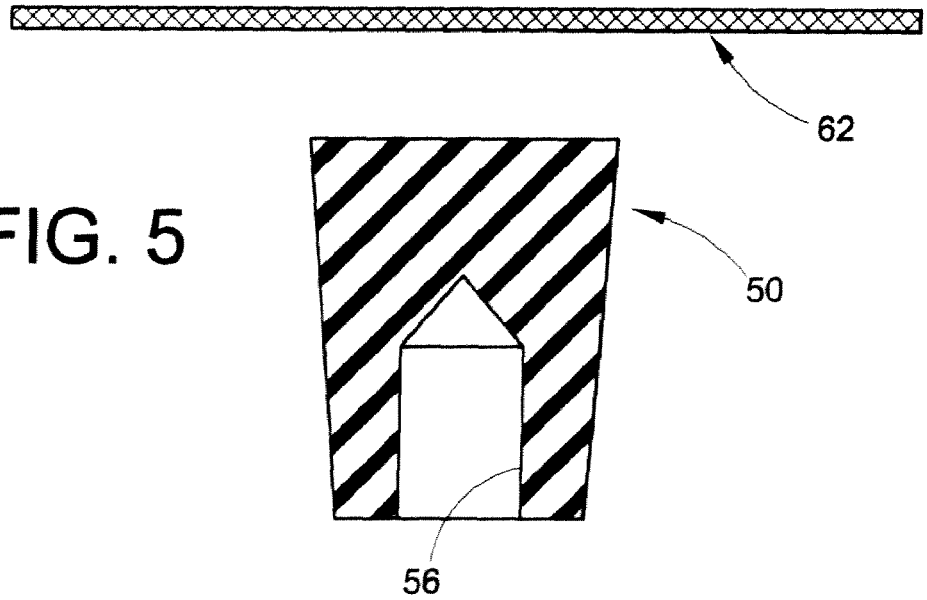

While a one-piece construction of the foregoing character is preferred, it will be appreciated that in accordance with the invention and as shown in FIGS. 4 and 5 of the drawing, respectively, filter member 48 can be used in conjunction with a wick member 60 of a material other than sintered plastic, and wick member 50 can be used in conjunction with a filter member 62 of a material other than sintered plastic. Moreover, filter member 48 can be used in a cartridge without a wick member in the outlet passage thereof, and a wick member 50 can be used in the outlet passage of a cartridge without a filter member extending across the inlet end of the passage.

While considerable emphasis has been placed herein on the preferred embodiments, it will be appreciated that other embodiments of the invention can be made and that many changes can be made in the preferred embodiments without departing from the principals of the invention. Accordingly, it is to be distinctly understood that the foregoing descriptive matter is to be interpreted merely as illustrative of the invention and not as a limitation, and that it is intended to include all embodiments and all modifications of the disclosed embodiment insofar as they come within the scope of the appended claims or the equivalents thereof.

Having thus described the invention, it is so claimed:

1. An ink cartridge comprising an ink chamber including a wall having an inner surface and an outer surface, an outlet port extending outwardly from said outer surface of said wall, an outlet passage through said port and communicating with said chamber, said passage for receiving a printer needle for dispensing ink from the chamber, and a filter member positioned on said inner surface of said wall and overlying said passage and extending along a length of said inner surface on opposite sides of said passage and a wick member in said passage, said filter member and wick member are integral and comprise sintered plastic material, wherein one of said filter member and said wick member comprises an axial bore defining a printer needle passage extending into one of said filter member and said wick member and wherein at least a portion of said wick member is tapered.

2. The ink cartridge according to claim 1, wherein said filter member is a strip of sintered plastic material on said inner surface of said wall in said chamber and extending across said passage.

3. The ink cartridge according to claim 1, wherein said needle passage is for receiving a printer needle having an outer surface and said axial bore has an inner surface spaced from said outer surface.

4. The ink cartridge according to claim 3, wherein said inner surface is spaced about 0.20 mm from said outer surface.

5. The ink cartridge according to claim 1, wherein said passage has an entrance end at said wall and an exit end spaced therefrom, said wick member including a body of sintered plastic material in said passage and extending from said entrance end toward said exit end.

6. The ink cartridge according to claim 5, wherein said body has a downstream end, and a sealing member in said passage between said downstream end of said body and said exit end of said passage.

7. The ink cartridge according to claim 1, wherein said filter member is positioned on said inner surface of said wall and extends across said passage and said wick member is positioned in said passage.

8. The ink cartridge according to claim 7, wherein said filter member is a strip of sintered plastic material and said wick member is a body of sintered plastic material.

9. The ink cartridge according to claim 8, wherein said body has a downstream end in said passage, and an axial bore defining a printer needle passage extending into said body from said downstream end thereof.

10. The ink cartridge according to claim 9, wherein said needle passage is for receiving a printer needle having an outer surface and said axial bore has an inner surface spaced from said outer surface.

11. The ink cartridge according to claim 10, wherein said inner surface is spaced about 0.20 mm from said outer surface.

12. The ink cartridge according to claim 10, wherein said passage has an entrance end at said wall and an exit end spaced therefrom, said body extending from said entrance end toward said exit end.

13. The ink cartridge according to claim 12, wherein said body has a downstream end, and a sealing member in said passage between said downstream end of said body and said exit end of said passage.

14. The ink cartridge according to claim 13, wherein said filter member has opposite sides and said body of said wick member is integral with and extends outwardly from one of the sides from said downstream end to be spaced from the one side.

15. The ink cartridge according to claim 1, wherein said filter member includes a planar strip of sintered plastic material having opposite sides and said wick member includes a body of said sintered plastic material extending outwardly from one of said sides and having an end spaced from the one side.

16. The ink cartridge according to claim 15, and an axial bore defining a printer needle passage extending into said body from said end toward said one side.

17. The ink cartridge according to claim 16, wherein said needle passage is for receiving a printer needle having an outer surface and said axial bore has an inner surface spaced from said outer surface.

18. The ink cartridge according to claim 17, wherein said inner surface is spaced about 0.20 mm from said outer surface.

19. A one piece, integrally formed filter and wick component for use in an ink jet cartridge, comprising a planar filter strip of sintered plastic material and a wick body of the same sintered plastic material extending from said strip and having an end spaced therefrom, wherein said wick body comprises a bore extending therethrough for receiving a printer needle and said wick body has a tapered configuration.

20. A filter and wick component according to claim 19, wherein the sintered plastic material is a polyethylene material.

21. A filter and wick component according to claim 19, wherein said bore is dimensioned so as to be spaced from printer needle received therein.

22. A filter and wick component according to claim 21, wherein the spacing is about 0.20 mm.

23. A filter and wick component according to claim 22, wherein the sintered plastic material is a polyethylene material.

24. A filter and wick component according to claim 19 in combination with an ink jet cartridge comprising:

an ink chamber including a wall, an outlet port extending outwardly from said wall, and an outlet passage through said port and communicating with said chamber, said passage for receiving a printer needle for dispensing ink from said chamber, wherein said planar filter strip is disposed on an inner surface of said wall in said chamber, a portion of said filter strip extending across an inlet end of said passage, wherein said wick body at least partially extends through said inlet end of said passage, said wick body end being disposed in said passage.

25. An ink cartridge comprising:

an ink chamber including a wall;

an outlet port extending downwardly from said wall, said outlet port having an inlet end located on said wall and an outlet end;

an outlet passage through said port and communicating with said chamber, said passage for receiving an associated printer needle for dispensing ink from said chamber; and an integral filter member and a wick member for filtering and dispensing ink flowing from said chamber into said outlet passage and the associated printer needle, at least one of said filter member and said wick member comprising a sintered plastic material, wherein said wall is configured to at least partially receive said filter member, said filter member being generally coplanar with said wall and extending along a longitudinal axis of said wall, on opposite sides of said outlet passage and overlying said inlet end of said passage, wherein said wick member is disposed in said passage.

26. The ink cartridge according to claim 25, wherein said wick member is a body of sintered plastic material including:

an upstream end communicating with said inlet end of said passage, a downstream end communicating with said outlet end of said passage, and a bore at least partially extending into said body from said downstream end thereof, the bore having an inner surface at least partially defining a printer needle passage, said needle passage being configured to at least partially receive the associated printer needle.

27. The ink cartridge according to claim 26, wherein said inner surface is circumferentially spaced from an outer surface of the associated printer needle.

28. The ink cartridge according to claim 27, wherein said inner surface is spaced about 0.20 mm from the outer surface.

29. The ink cartridge according to claim 25, wherein said filter member is a generally rectangular strip of sintered plastic material, said wall including a recess for at least partially receiving said filter member in said chamber, said filter member extending across said inlet end of said passage.

* * * * *